United States Patent [19]

Lowe

[11] Patent Number: 4,721,212

[45] Date of Patent: Jan. 26, 1988

[54] MODULAR ARTICLE SUPPORT UNIT

[76] Inventor: Richard B. Lowe, 8615 Algecrias, Apt. 2A, Indianapolis, Ind. 46250

[21] Appl. No.: 917,475

[22] Filed: Oct. 9, 1986

[51] Int. Cl.[4] ..... A47F 5/00

[52] U.S. Cl. ..... 211/86; 211/96; 16/223

[58] Field of Search ..... 211/86, 32, 102, 96; 248/283; 16/223

[56] References Cited

U.S. PATENT DOCUMENTS

| | | | |
|---|---|---|---|
| 914,697 | 3/1909 | Bryant | 16/223 X |
| 1,837,692 | 12/1931 | Thomas | 211/86 X |
| 2,176,723 | 10/1939 | Sauer | 16/223 X |
| 2,595,521 | 5/1952 | Hanson | 211/86 |
| 2,684,225 | 7/1954 | Johnson | 211/86 X |
| 2,895,698 | 7/1959 | Palmer | 211/96 X |
| 3,044,630 | 7/1962 | Szabo | 211/86 |
| 3,175,696 | 3/1965 | Milbourne | 211/86 |
| 3,825,127 | 7/1974 | Morrison et al. | 211/96 |

*Primary Examiner*—Ramon S. Britts
*Assistant Examiner*—Blair Johnson
*Attorney, Agent, or Firm*—Wallace E. Weakley

[57] ABSTRACT

A modular article support unit consisting of an elongated tubular member adapted to be removably attached to the hinge pins of two hinges of a door by means of adjustable brackets, said elongated tubular member having a plurality of holes along the length thereof for removably attaching several different types of support devices, such as coat hooks, towel racks, bulletin boards and mirrors.

8 Claims, 8 Drawing Figures

MODULAR ARTICLE SUPPORT UNIT

FIELD OF THE INVENTION

The present invention relates to a modular article support unit adapted for mounting to the hinges of a door for providing support units for articles, such as clothing, towels, and the like, and more specifically, for a modular unit provided with various types of hanging, support, and storage devices, such as coat hooks, towel racks, bulletin boards and mirrors.

DESCRIPTION OF THE PRIOR ART

Many prior art devices designed for attachment to or supported by door hinges for the placement and storage of articles have been proposed. Early devices were designed to be clamped onto hinge pins of the hinges of doors for supporting storage and holding devices such as clothes drying racks, as evidenced by U.S. No. 2,595,521 to Hanson. However, as shown in the Hanson structure, the clothes drying rack was only useful in supporting small articles. A more recent device shown by U.S. Pat. No. 2,684,225 to Johnson is designed to be clamped on the ends of door hinges for support of an elongated rod which has a plurality of support racks extented thereform for supporting clothes hangers, shelves, tie racks, and other appliances and devices. However, the Johnson device is designed to be attached to the door hinge by clamping a support bracket shown in FIG. 2, around each end of the door hinge pin, and, therefore, cannot support very much weight.

A still further device is shown in U.S. Pat. No. 3,175,696 to Milbourne, which replaces the door hinge pin itself with an extended end portion of a support frame. Simplified versions of door hinge pin supported devices are shown in U.S. Pat. Nos. 2,270,802 to Kristensen and 3,044,630 to Szabo.

Although each of the foregoing prior art devices disclose article hangers and article storage devices designed to be supported by or as a replacement for door hinge pins to store articles behind a door, each of the prior art devices presents certain drawbacks to their use. For example, the Hanson and Johnson devices cannot support any significant weight, due to the fact that they are designed to be clamped over the ends of the door hinge pins. The device disclosed by Milbourne cannot support a great amount of weight, due to the fact that the longitudinal axis of the main support bar 27 is spaced a great distance from the longitudinal axis of the hinge pins thereby reducing its rigidity. The early prior art devices of Kirstensen and Szabo present small singular hook devices that can only provide for a minimal amount of storage for support of a minimal number of articles.

SUMMARY OF THE PRESENT INVENTION

The present invention seeks to overcome the deficiencies and drawbacks of the prior art devices by presenting a unique modular article support unit that is adapted to be mounted to door hinges of doors of varying heights and to provide a door hinge pin supported modular article support unit that has great rigidity and strength and is readily adaptable for the attachment of various types of article holding, supporting, and storage devices, such as coat hooks, tie racks, towel racks, bulletin boards, mirrors, and other devices.

The present invention further presents a modular article support unit that is economical to produce, while providing for the attachment of a multiplicity of article support and storage devices as the user desires.

These and other advantages of the present invention may be readily seen upon reading the description of the preferred embodiments and viewing the drawing accompanying the description of the preferred embodiments.

DESCRIPTION OF THE PREFERRED EMBODIMENTS

A description of the preferred embodiments of the present invention will now be made with reference to the accompanying Drawings.

Figure 1:
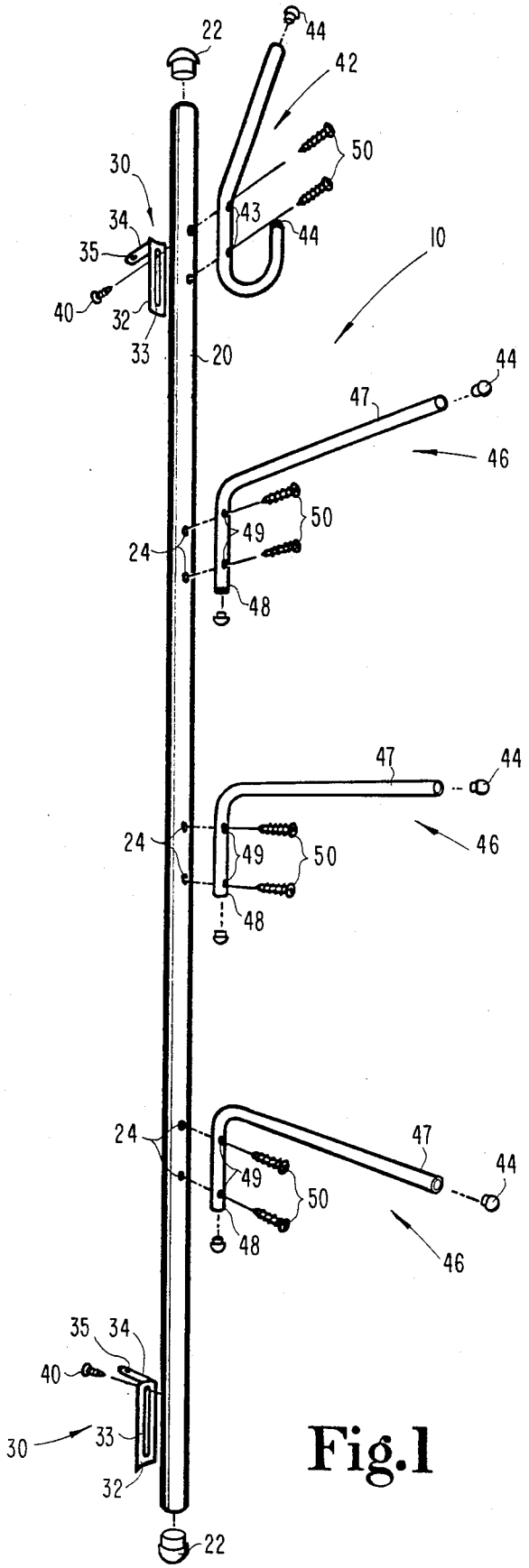
FIG. 1 is an exploded view of the unit according to the present invention.

As shown in FIG. 1, the modular article support unit assembly 10 according to the present invention consists of an elongated member 20 which may be of either solid or tubular construction. The preferred embodiment illustrated in FIG. 1 shows the elongated member as being of tubular construction. If desired, the ends of the tubular member 20 may be sealed by means of end caps 22 inserted into the upper and lower ends, respectively, of the the elongated tubular member 20.

Hinge mounting means in the form of angled brackets 30 are adjustably attached to openings in the elongated tubular member 20 in alignment with each other by attaching means 40. The attaching means 40 may be in the form of sheet metal screws, bolts, clips, clamps, or other similar devices. The hinge mounting means 30 is formed with a slotted arm 32 having an elongated adjusting slot 33 formed therein. The slotted arm 32 is positioned next to the elongated tubular member 20 and may be adjusted by means of the slot 33 to adapt the device according to the present invention to door hinges having various spacings. A second hinge mounting arm 34 is formed on the hinge mounting means perpendicular to the slotted arm 32. The hinge mounting arm 34 has a hole or opening 35 therethrough to accomodate the insertion of a door hinge pin for attaching the device according to the present invention to the door hinges of a door. The opoening 35 in the hinge mounting arm 34 is positioned in such a manner so as to prevent the elongated member 20 from interferring with the door hinge components, while positioning the elongated tubular member in close proximity to the door hinge pivot axis to reduce the cantilever effect of items and articles placed on the modular units attached to the elongated tubular member 20.

As shown further in FIG. 1, a plurality of openings 24 are formed along the length of the elongated tubular member in alignment with each other and directly opposite the hinge mounting means 30 for removably attaching the modular article support units and other modular units illustrated in the remaining Figures and adapted for attachment to the elongated member 20 in accordance with the present invention.

As shown in FIG. 1, the modular article support unit according to the present invention has attached thereto a coat hook 42 which has attachment openings 43 formed through the coat hook for removably attaching the coat hook 42 to the tubular member 20 by attaching means, such as screws 50. The attaching openings 43 are spaced apart on the coat hook the same distance as the spacings for the attaching openings 24 in the elongated tubular member. If desired, end caps 44 may be pressed into the ends of the tubular coat hook 42.

As shown further in FIG. 1, the modular article support unit according to the present invention has a plurality of towel racks 46 removably attached thereto. The towel racks may be of tubular construction having a long arm for holding washclothes, towels, and the like, formed at right angles to a short attaching arm 48. The short attaching arm 48 has a plurality of attaching openings 49 formed therethrough in spaced apart relationship. The spacing of the attaching openings 49 corresponds to the attaching openings 24 formed in the elongated tubular member 20. The towel racks 46 may be removably attached to the elongated tubular member 20 of the modular article support unit 10 according to the present invention by attaching means such as sheet metal screws 50, or bolts, clamps, or other attaching means.

Figure 2:
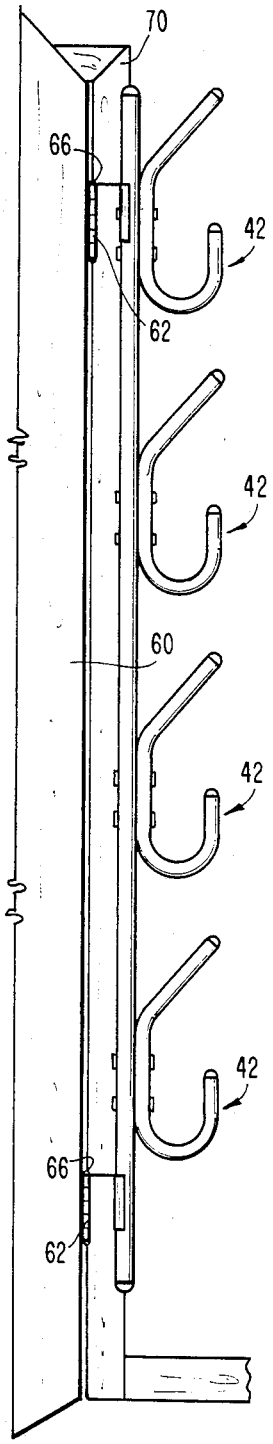
FIG. 2 is a view of the unit according to the present invention mounted on the hinge pins of a door.

Referring to FIG. 2, the installation of the device according to the present invention will now be described. As shown in FIG. 2, a door 60 is hinged to a door casement 70 by means of an upper hinge assembly 62 and a lower hinge assembly 64. Each of the upper and lower hinge assemblies 62 and 64 has a hinge pin 66 therein. In operation, the modular article support or storage members shown in FIG. 2 in the form of coat hooks 42 are attached to the elongated tubular member 20 by means of the attaching means or screws 50 after the end caps 44 have been inserted into the hook 42. The hinge mounting bracket 30 is attached to the tubular member 20 by means of the attaching means 40 in the form of sheet metal screws or similar devices placed through the adjusting slot 33. The hinge mounting brackets 30 are then adjusted to correspond to the distance between the tops of the hinges 62 and 64. The hinge pins 66 are placed through the openings 35 of the hinge pin mounting arm 34 and then inserted into the hinge itself. The door 60 may then be opened and closed in the normal manner and the modular article support unit 10 according to the present invention can be used to hold towels, coats, and other articles behind the door itself.

Figure 3:
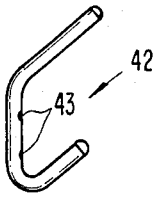
FIG. 3 is a view of a coat hook used with the present invention.

As illustrated in FIG. 3, the coat hook 42 may have a different configuration than that illustrated in FIGS. 1 and 2. However, the coat hook 42 illustrated in FIG. 3 utilizes attaching openings of holes 43 which correspond to the openings 24 in the elongated tubular member 20, so that the hook 42 may be mounted at the desired location along the length of the tubular member 20.

Figure 4:
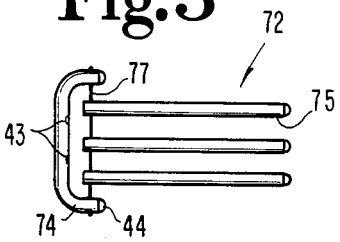
FIG. 4 is a view of a tie/towel rack used with the present invention.

FIG. 4 of the Drawings illustrates a three bar towel rack 72 consisting of three moveable horizontal rods 75 which may be selectively positioned to support towels and the like. The ends of the rods 75 may be pluged with end caps 44 in the same manner as the coat hooks 42 and single bar rods 46 shown in FIG. 1. The moveable rods 75 are supported by a U-shaped mounting bracket 74. The mounting bracket 74 has holes or openings 43 therethrough which correspond to the attaching holes or openings 24 in the elongated tubular member 20 of the assembly 10. The moveable rods 75 are supported between the angled ends of the mounting brackets 74 by means of a rods or shaft 77 extending through holes in the rods 75 and secured at each end with the mounting bracket 74 by any desired known means. Again, as with the coat hooks, the moveable towel rack assembly 72 may be selectively mounted along the length of the elongated tubular member 20 of the assembly 10 at any desired location by fastening means, such as sheet metal screws 50.

Figure 5:
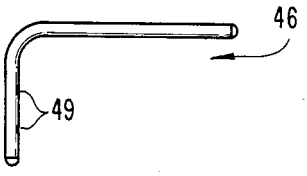
FIG. 5 is a view of a single bar article support used with the present invention.

FIG. 5 illustrates a detailed view of the single bar towel rack 46 shown in FIG. 1 and described hereinabove.

Figure 6:
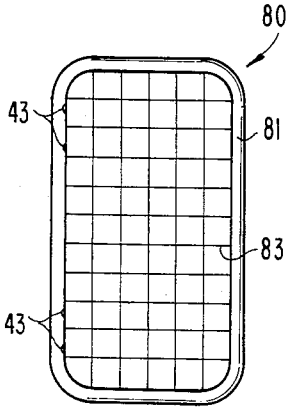
FIG. 6 is a plan view of a grid support device used with the present invention.

FIG. 6 illustrated a further module that may be attached to the elongated tubular member 20 of the assembly 10, which module is a support rack or grid 80. The support grid assembly 80 consists of a rigid frame 81 surrounding and supporting a rigid metal grid 82 to which various items may be clipped or attached. The rigid frame 81 has two sets of holes 43 at the upper and lower ends of one side thereof for attachment to the tubular member 20 by means of attaching screws 50. Various items and articles may be selectively clipped to or hooked on the grid 82 of the assembly 80.

Figure 7:
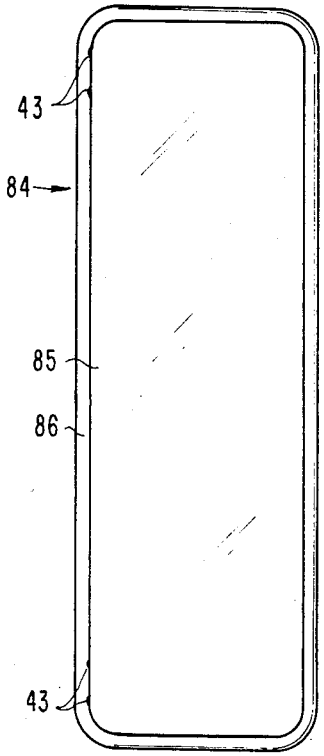
FIG. 7 is a plan view of a mirror assembly used with the present invention.

FIG. 7 illustrates a mirror assembly 84 which may be removably attached to the elongated tubular member of the modular assembly 10. The mirror assembly 84 consists of a mirror unit 85 mounted within a frame member 86. The frame member 86 has a plurality of attaching holes or openings 43 at the upper and lower ends of one side thereof. The attaching holes or openings 43 at the upper and lower ends of one side of the frame 86 correspond to the holes or openings 24 in the elongnated tubular member 20, so that the mirror assembly 84 may be removably attached to the tubular member 20 of the modular unit 10.

Figure 8:
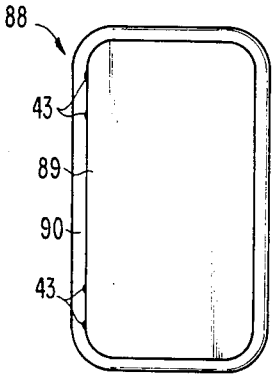
FIG. 8 is a plan view of a bulletin/blackboard assembly used with the present invention.

FIG. 8 illustrates a bulletin board assembly 88 which may be removably mounted on the tubular member 20 of the modular unit 10 by means of mounting holes or openings 43 located in a frame member 90. The frame member 90 surrounds a bulletin board 89. The bulletin board assembly 88 may be removably attached to the tubular member 20 of the modular unit 10 to be used to place notes and the like thereon.

As can be seen from viewing the Drawings taken in light of the foregoing description, the modular article support unit 10 may have a variety of modules mounted thereon for various uses and purposes. The various modules and components may be selectively mounted to the unit assembly 10 as the user desires. In addition, the assembly 10 may be mounted on various doors throughout a house or building with various modules attached thereto for various purposes and uses. By utilizing the mounting brackets in accordance with the present invention, the elongated tubular member 20 and the modules attached thereto are mounted in close proximity to the hinge pin axis and the door edge to reduce the cantilever effect, thereby enabling the assembly to support greater amounts of weight then the prior art devices.

What is claimed is:

1. A modular support and storage unit comprising a vertically oriented elongated member having at least one storage and support device removably attached thereto, a plurality of mounting means for removably attaching said elongated member to the door hinges of a door, each of said mounting means comprising an L-shaped bracket having a vertical portion and a horizontal portion, said horizontal portion having an opening therethrough for allowing the insertion of a door hinge pin therethrough for attaching said mounting means to the door hinges said vertical portion having a vertically extending elongated slot, said mounting means being spaced apart and in vertical alignment with each other and adapted for mounting said elongated member in close proximity to said door hinges, said elongated member having a plurality of first attaching openings along the length thereon on the side opposite said hinge mounting means; said at least one article support means being removably attached to said elongated member by attaching means inserted into said attaching openings in said elongated member said elongated member further having second attaching openings on the same side thereof as said hinge mounting means whereby fastening means engage the elongated slot of said bracket and said second openings thereby adjustably mounting said hinge mounting means to said elongated member.

2. A modular unit as set forth in claim 1, wherein said first attaching openings are formed along the length of said elongated member on the side opposite said hinge mounting means, said first attaching openings being formed in a predetermined spaced-apart relationship corresponding with attaching openings formed in components and modules mounted to said elongated member.

3. A modular unit as set forth in claim 1, wherein said article storage and support means comprises a tubular member having an upper end formed in an angled position and a lower end bent upwardly in a curved position to form a hook, two attaching openings formed through a straight portion of said article support means said attaching openings in said article support means being spaced apart from each other and having a spaced apart dimension corresponding to the spaced apart dimensions of the first attaching openings formed in said elongated member, and attaching means for removably attaching said article support means to said elongated member.

4. A modular unit as set forth in claim 1, wherein said article support means is formed of an angular member having one arm formed at right angles to a second arm, one of said arms having a length greater than the second arm, the shorter arm having attaching openings in spaced apart relation to each other corresponding to the first attaching openings formed in said elongated member, and attaching means for removably attaching said angled bracket to said elongated member.

5. A modular unit as set forth in claim 1, wherein said article support means comprises a bracket having each end formed at right angles to a main portion, said main portion having a plurality of attaching openings therethrough in spaced-apart relationship with each other, the distance between said attaching openings in said main portion corresponding to the distance between said first attaching openings in said elongated member, a support rod extending between the two end members of said bracket formed at right angles to said main portion, and at least one tubular support member extending from said support rod at right angles thereto.

6. A modular unit as set forth in claim 1, wherein said article support member comprises an open mesh grid having a rigid frame surrounding said grid, and a plurality of attaching openings formed at an upper and lower end of one side of said frame for mounting said grid assembly to said tubular member of said modular unit.

7. A modular unit as set forth in claim 1, wherein said article support means further comprises a mirror assembly consisting of a mirror unit mounted in a frame member, said frame member having attaching openings formed in the upper and lower ends thereof, said attaching openings corresponding to the first attaching openings in said elongated member, and attaching means for removably securing said frame member to said elongated tubular member.

8. A modular unit as set forth in claim 1, wherein said article support means further comprises a bulletin board assembly consisting of a bulletin board unit mounted in a frame member, said frame member having attaching openings formed in the upper and lower ends thereof, said attaching openings corresponding to the first attaching openings in said elongated member, and attaching means for removably securing said frame member to said elongated tubular member.

* * * * *